US009118122B2

(12) United States Patent
Liu et al.

(10) Patent No.: US 9,118,122 B2
(45) Date of Patent: Aug. 25, 2015

(54) ASSEMBLY OF AN ELECTRICAL CONNECTOR AND A CABLE UNIT AND ELECTRONIC DEVICE INCLUDING THE ASSEMBLY

(71) Applicant: Wistron Corporation, New Taipei (TW)

(72) Inventors: Yu-Ju Liu, New Taipei (TW); Che-Wen Liu, New Taipei (TW); Jui-Lin Hsiao, New Taipei (TW)

(73) Assignee: Wistron Corporation, New Taipei (TW)

( * ) Notice: Subject to any disclaimer, the term of this patent is extended or adjusted under 35 U.S.C. 154(b) by 38 days.

(21) Appl. No.: 14/231,431

(22) Filed: Mar. 31, 2014

(65) Prior Publication Data

US 2015/0118918 A1 Apr. 30, 2015

(30) Foreign Application Priority Data

Oct. 29, 2013 (TW) ..... 102220092 A

(51) Int. Cl.
*H01R 4/10* (2006.01)
*H01R 4/18* (2006.01)

(52) U.S. Cl.
CPC ..... *H01R 4/18* (2013.01)

(58) Field of Classification Search
CPC ..... H01R 4/18; H01R 13/115; H01R 4/185; H01R 13/113; H01R 13/20; H01R 12/585; H01R 13/432
USPC ..... 439/877, 849, 850, 846, 847, 872, 746, 439/743, 745
See application file for complete search history.

(56) References Cited

U.S. PATENT DOCUMENTS

| | | | | |
|---|---|---|---|---|
| 3,363,224 | A * | 1/1968 | Gluntz et al. | 439/852 |
| 3,546,663 | A * | 12/1970 | Centre, Jr. | 439/849 |
| 5,344,348 | A * | 9/1994 | Willis et al. | 439/849 |
| 5,667,414 | A * | 9/1997 | Karacora | 439/849 |
| 7,462,080 | B2 * | 12/2008 | Shiraishi et al. | 439/852 |

* cited by examiner

*Primary Examiner* — Hae Moon Hyeon
(74) *Attorney, Agent, or Firm* — The Mueller Law Office, P.C.

(57) ABSTRACT

An assembly includes an electrical connector, a cable unit, and adapter terminals. The electrical connector includes an insulator body and conductive terminals disposed at the insulator body. Each conductive terminal includes an insert arm positioned outside the insulator body. The cable unit includes a plug connector and cables connected to the plug connector. Each of the adapter terminals is connected to a core wire of a corresponding cable and is sleeved on the insert arm of a corresponding conductive terminal. Each adapter terminal is electrically connected between the core wire of the corresponding cable and the insert arm of the corresponding conductive terminal.

20 Claims, 11 Drawing Sheets

ASSEMBLY OF AN ELECTRICAL CONNECTOR AND A CABLE UNIT AND ELECTRONIC DEVICE INCLUDING THE ASSEMBLY

CROSS-REFERENCE TO RELATED APPLICATION

This application claims priority of Taiwanese Application No. 102220092, filed on Oct. 29, 2013, the entire disclosure of which is incorporated herein by reference.

BACKGROUND OF THE DISCLOSURE

1. Field of the Disclosure

The disclosure relates to an assembly of an electrical connector and a cable unit, more particularly to an assembly of an electrical connector and a cable unit in which a plurality of conductive terminals of the electrical connector are electrically connected to a plurality of cables of the cable unit via a plurality of adapter terminals therebetween. The disclosure also relates to an electronic device including the assembly.

2. Description of the Related Art

Referring to FIG. 1, a presently available electronic device 1, for example, a notebook computer or a tablet computer, includes a shell body 11, a mother board 12 disposed within the shell body 11, and an audio connector 13 disposed within the shell body 11. The audio connector 13 is proximate to a side wall 111 of the shell body 11 and positionally corresponds to an opening 112 in the side wall 111. Since the mother board 12 is influenced by the inner space limitations of the shell body 11, the mother board 12 cannot be disposed in a position proximate to the side wall 111. Therefore, a plurality of conductive terminals (not shown) of the audio connector 13 have to be soldered onto a circuit board 14, and an electric signal from the audio connector 13 is transmitted through a cable unit 15 electrically connected between the circuit board 14 and the mother board 12. The cable unit 15 includes two plug connectors 151 at two opposite ends thereof. The plug connectors 151 are respectively connected to a socket connector 121 of the mother board 12 and a socket connector 141 of the circuit board 14 so that the cable unit 15 is electrically connected between the mother board 12 and the circuit board 14.

Since the conductive terminals of the audio connector 13 have to be soldered onto the circuit board 14 so as to electrically connect the audio connector 13 to the mother board 12 through the circuit board 14 and the cable unit 15, the assembling procedure is relatively complicated and time-wasting.

SUMMARY OF THE DISCLOSURE

Therefore, an object of the present disclosure is to provide an assembly of an electrical connector and a cable unit, wherein assembling convenience is enhanced and assembling time is reduced by electrically connecting a plurality of conductive terminals of the electrical connector to a plurality of cables of the cable unit via a plurality of adapter terminals.

Accordingly, an assembly of an electrical connector and a cable unit of this disclosure includes an electrical connector, a cable unit, and a plurality of adapter terminals.

The electrical connector includes an insulator body and a plurality of conductive terminals disposed at the insulator body. Each of the conductive terminals protrudes partly outside the insulator body, and includes an insert arm positioned outside the insulator body. The cable unit includes a plug connector and a plurality of cables connected to the plug connector. Each of the cables includes a core wire. Each of the adapter terminals is connected to the core wire of a corresponding one of the cables and is sleeved on the insert arm of a corresponding one of the conductive terminals. Each of the adapter terminals is electrically connected between the core wire of the corresponding one of the cables and the insert arm of the corresponding one of the conductive terminals.

Preferably, each of the conductive terminals further includes a protruding arm protruding from the insulator body. The protruding arm has a top surface and a distal end distal from the insulator body. The insert arm extends upward from the distal end of the protruding arm. Each of the adapter terminals includes a base plate, two sleeve plates respectively connected to two opposite sides of the base plate and disposed to sleeve on the insert arm of the corresponding one of the conductive terminals, and two first gripping plates respectively connected to the opposite sides of the base plate and disposed to grip the core wire of the corresponding one of the cables. The two sleeve plates of each of the adapter terminals are sleeved on the insert arm of the corresponding one of the conductive terminals along a downward assembling direction.

Preferably, for each of the adapter terminals, the base plate has a first surface and a second surface opposite to the first surface. The two sleeve plates extend from the base plate in a direction opposite to the second surface, and the two first gripping plates extend from the base plate in a direction opposite to the first surface.

Preferably, each of the cables further includes an insulator sheath covering the core wire. Each of the adapter terminals further includes two second gripping plates respectively connected to the opposite sides of the base plate and disposed to grip the insulator sheath of the corresponding one of the cables. The two second gripping plates extend from the base plate in the direction opposite to the first surface. The two second gripping plates are positioned between the two first gripping plates and the two sleeve plates.

Alternatively, each of the cables further includes an insulator sheath covering the core wire. Each of the adapter terminals further includes two second gripping plates respectively connected to the opposite sides of the base plate and disposed to grip the insulator sheath of the corresponding one of the cables. The two second gripping plates extend from the base plate in the direction opposite to the first surface. The two first gripping plates are positioned between the two second gripping plates and the two sleeve plates.

Preferably, for each of the adapter terminals, the base plate cooperates with the two sleeve plates to define a receiving slot and a bottom opening in spatial communication with the receiving slot. The insert arm of the corresponding one of the conductive terminals is extended into the receiving slot through the bottom opening. The insert arm of each of the conductive terminals includes at least one support face and at least one stop face spaced apart from and located above the support face. One of the sleeve plates includes an abutting face abutting against the support face of the insert arm of the corresponding one of the conductive terminals, and a resilient arm located below the stop face of the insert arm of the corresponding one of the conductive terminals. The stop face stops the resilient arm to prevent the insert arm from separating from the receiving slot through the bottom opening.

Preferably, the insert arm of each of the conductive terminals includes an extending segment extending upward from the distal end of the protruding arm and having a top end, and an insert segment extending upward from the top end of the extending segment and having two opposite sides. The insert segment has a width shorter than that of the extending segment. The extending segment has two of the support faces located on the top end and respectively connected to the opposite sides of the insert segment. Each of the sleeve plates of each of the adapter terminals has a lower surrounding plate segment connected to the base plate and disposed to surround the insert segment of the insert arm of the corresponding one of the conductive terminals. The lower surrounding plate segment includes aside plate portion. The side plate portions of the lower surrounding plate segments of the sleeve plates of each of the adapter terminals are located respectively at the opposite sides of the insert segment of the insert arm of the corresponding one of the conductive terminals. The side plate portion has the abutting face at a bottom of the side plate portion for abutting against a corresponding one of the support faces of the extending segment of the insert arm of the corresponding one of the conductive terminals.

Preferably, each of the sleeve plates of each of the adapter terminals has the resilient arm extending upward from a top end of the side plate portion and inclining inward. The resilient arm has a top locking end. The insert segment of the insert arm of each of the conductive terminals has a neck portion connected to the extending segment, and a top pushing head portion formed on a top end of the neck portion. The top pushing head portion is disposed to push the resilient arms of the sleeve plates of the corresponding one of the adapter terminals to deform and bend outward. The top pushing head portion has two bottom stop faces connected respectively to opposite sides of the neck portion for stopping the top locking ends of the resilient arms of the corresponding one of the adapter terminals.

Preferably, the top pushing head portion of the insert segment of the insert arm of each of the conductive terminals further has a curved top pushing face for pushing the resilient arms of the two sleeve plates of the corresponding one of the adapter terminals.

Preferably, the neck portion of the insert segment of the insert arm of each of the conductive terminals has two opposite upright side surfaces and two inclined side surfaces respectively connected to top ends of the two upright side surfaces. The two inclined side surfaces extend upward and converge toward each other and are respectively connected to the bottom stop faces of the top pushing head portion. The lower surrounding plate segments of each of the adapter terminals surround the neck portion of the insert segment of the insert arm of the corresponding one of the conductive terminals. The side plate portions of the lower surrounding plate segments are disposed outwardly and respectively of the upright side surfaces of the neck portion of the insert segment of the insert arm of the corresponding one of the conductive terminals. The resilient arms of each of the adapter terminals grip the inclined side surfaces of the neck portion of the insert segment of the insert arm of the corresponding one of the conductive terminals. Each of the sleeve plates of each of the adapter terminals further includes an upper surrounding plate segment connected to the base plate and spaced apart from and located above the resilient arms. The upper surrounding plate segments of the sleeve plates surround the top pushing head portion of the insert segment of the insert arm of the corresponding one of the conductive terminals.

Another object of the present disclosure is to provide an electronic device including the aforementioned assembly of an electrical connector and a cable unit, wherein assembling convenience is enhanced and assembling time is reduced by electrically connecting a plurality of conductive terminals of the electrical connector to a plurality of cables of the cable unit via a plurality of adapter terminals.

Accordingly, an electronic device of this disclosure includes a shell body, a mother board, an electrical connector, a cable unit, and a plurality of adapter terminals.

The shell body is formed with a receiving space. The shell body includes a side wall formed with an opening that is in spatial communication with the receiving space. The mother board is disposed within the receiving space and includes a socket connector.

The electrical connector is disposed in the receiving space and is disposed proximate to the side wall. The electrical connector includes an insulator body and a plurality of conductive terminals disposed at the insulator body. The insulator body is formed with an insert hole corresponding to the opening. Each of the conductive terminals protrudes partly outside the insulator body, and includes an insert arm positioned outside the insulator body. The cable unit is disposed in the receiving space. The cable unit includes a plug connector connected to the socket connector, and a plurality of cables connected to the plug connector. Each of the cables includes a core wire. Each of the adapter terminals is connected to the core wire of a corresponding one of the cables and is sleeved on the insert arm of a corresponding one of the conductive terminals. Each of the adapter terminals is electrically connected between the core wire of the corresponding one of the cables and the insert arm of the corresponding one of the conductive terminals.

The effect of the present disclosure lies in that each of the adapter terminals is connected to the core wire of a corresponding one of the cables and is sleeved on the insert arm of a corresponding one of the conductive terminals so that each of the conductive terminals of the electrical connector is electrically connected to the core wire of the corresponding one of the cables through a corresponding one of the adapter terminals. Assembling convenience is enhanced and assembling time is also reduced.

BRIEF DESCRIPTION OF THE DRAWINGS

Other features and advantages of the present disclosure will become apparent in the following detailed description of the embodiments with reference to the accompanying drawings, of which.

DETAILED DESCRIPTION OF THE EMBODIMENTS

Figure 1:
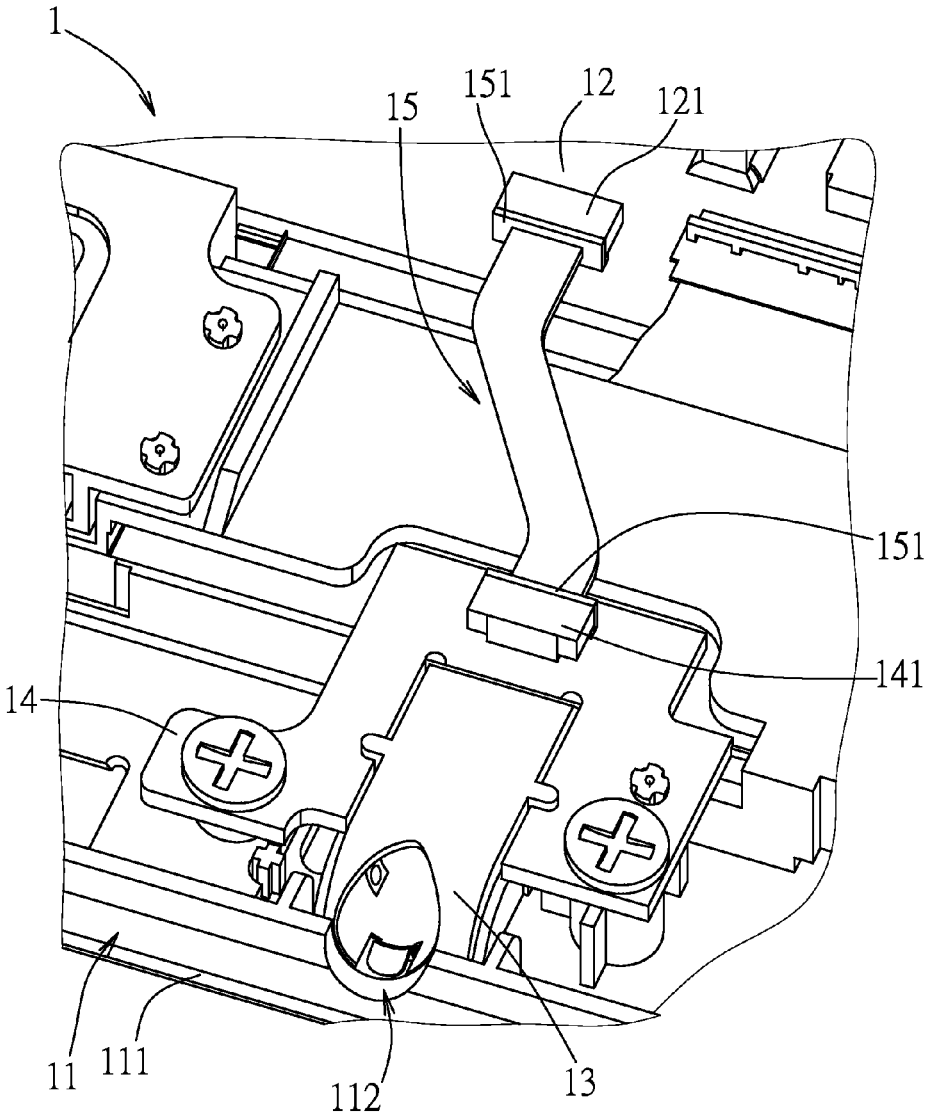
F I G. 1 PRIOR ART
FIG. 1 is a fragmentary enlarged perspective view of a presently available electronic device to illustrate that a plurality of conductive terminals of an audio connector are soldered onto a circuit board and that the circuit board is electrically connected to a mother board through a cable unit.

Before the present disclosure is described in greater detail, it should be noted that like elements are denoted by the same reference numerals throughout the disclosure.

Figure 2:
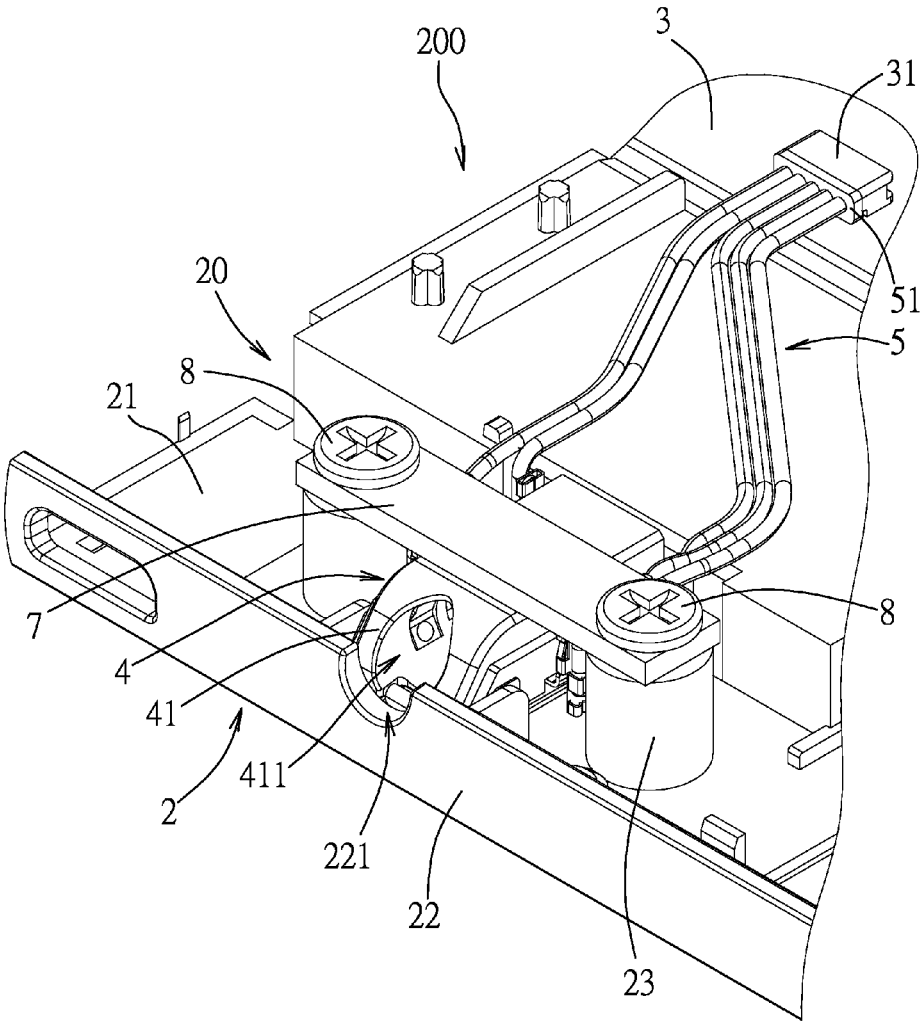
FIG. 2 is a fragmentary enlarged perspective view of a first embodiment of an electronic device including an assembly of an electrical connector and a cable unit according to this disclosure to illustrate that a baffle plate abuts against the top of an insulator body of an electrical connector so that the electrical connector is firmly positioned within a shell body.
Figure 3:
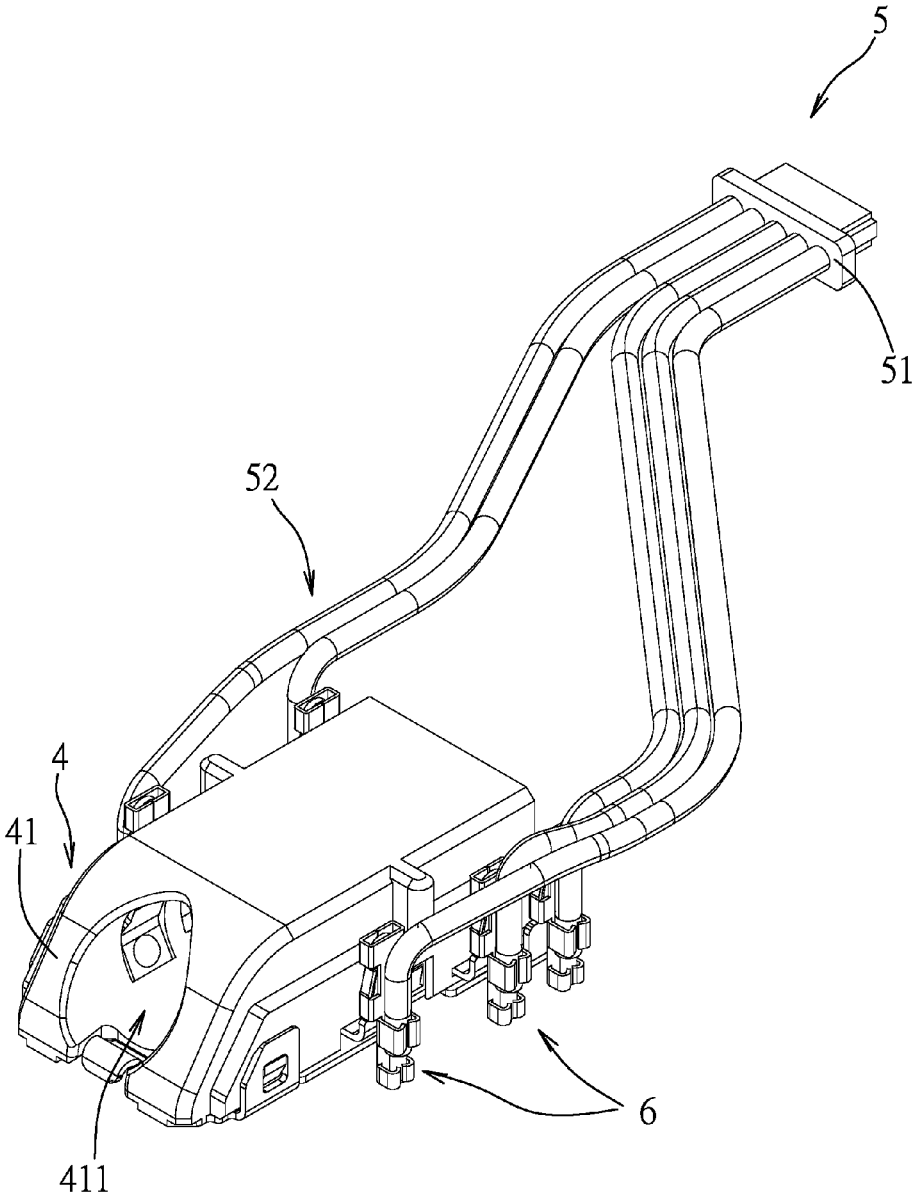
FIG. 3 is a perspective view of the first embodiment of an electronic device including an assembly of an electrical connector and a cable unit according to this disclosure to illustrate that each of adapter terminals is connected to a core wire of a corresponding one of cables and is sleeved on an insert arm of a corresponding one of conductive terminals.

Referring to FIGS. 2 and 3, a first embodiment of an electronic device 200 according to this disclosure is shown to include a shell body 2, a mother board 3, an electrical connector 4, a cable unit 5, and a plurality of adapter terminals 6.

Referring to FIGS. 2, 3, 4, and 5, the shell body 2 is formed with a receiving space 20. The shell body 2 includes a bottom wall 21, and a side wall 22 connected to a side of the bottom wall 21. The side wall 22 is formed with an opening 221 that is in spatial communication with the receiving space 20. The mother board 3 is disposed within the receiving space 20 and includes a socket connector 31.

The electrical connector 4 in this embodiment is illustrated using an audio connector. The electrical connector 4 is disposed in the receiving space 20, and is disposed on the bottom wall 21 and proximate to the side wall 22. The electrical connector 4 includes an insulator body 41 and a plurality of conductive terminals 42 disposed at the insulator body 41. The insulator body 41 is formed with an insert hole 411 corresponding to the opening 221. Thereby, a wire connector (not shown) may be inserted into the insert hole 411 through the opening 221 so that a plurality of terminals (not shown) of the wire connector are correspondingly electrically connected to the conductive terminals 42. Each of the conductive terminals 42 protrudes partly outside the insulator body 41, and includes an insert arm 421 positioned outside the insulator body 41.

The cable unit 5 is disposed in the receiving space 20. The cable unit 5 includes a plug connector 51 connected to the socket connector 31, and a plurality of cables 52 connected to the plug connector 51. Each of the cables 52 includes a core wire 521. Each of the adapter terminals 6 is connected to the core wire 521 of a corresponding one of the cables 52 and is sleeved on the insert arm 421 of a corresponding one of the conductive terminals 42. Each of the adapter terminals 6 is electrically connected between the core wire 521 of the corresponding one of the cables 52 and the insert arm 421 of the corresponding one of the conductive terminals 42. As described above, each of the adapter terminals 6 is connected to the core wire 521 of a corresponding one of the cables 52 and is sleeved on the insert arm 421 of a corresponding one of the conductive terminals 42 so that each of the conductive terminals 42 of the electrical connector 4 is electrically connected to the core wire 521 of a corresponding one of the cables 52 through a corresponding one of the adapter terminals 6. Compared to the aforesaid prior art, it is not necessary to solder the conducive terminals 42 of the electrical connector onto a circuit board. Therefore, assembling convenience is enhanced and assembling time is reduced. Furthermore, the circuit board 14, a socket connector 141 of the circuit board 14, and two plug connectors 151 of the cable unit 15 required in the aforesaid prior art may be omitted. Therefore, the cost for manufacturing these components can be saved.

The specific structures and the assembling manners of the conductive terminals 42 of the electrical connector 4, the cables 52 of the cable unit 5, and the adapter terminals 6 will now be described in detail.

Figure 6:
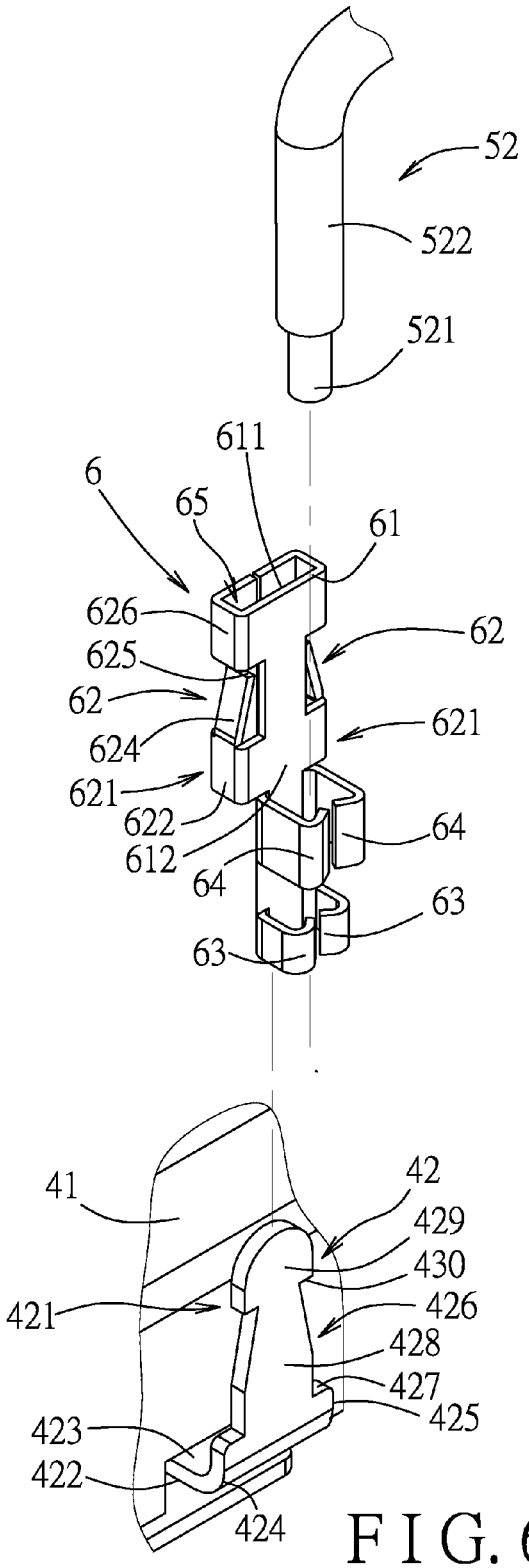
FIG. 6 is an enlarged view of a portion of FIG. 4 to illustrate the assembling relationship of the adapter terminals, the cables, and the conductive terminals.
Figure 7:
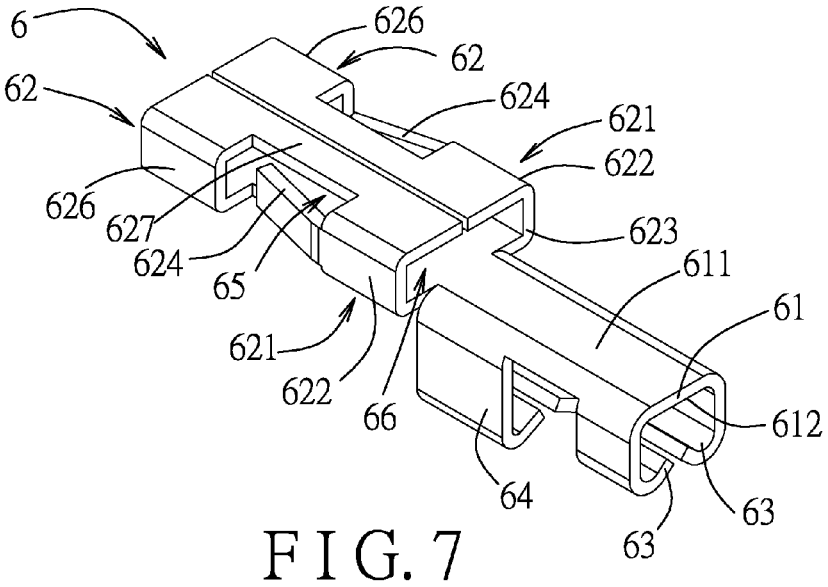
FIG. 7 is a perspective view of the adapter terminal of the first embodiment of an electronic device including an assembly of an electrical connector and a cable unit according to this disclosure to illustrate detailed configuration of the adapter terminal.
Figure 8:
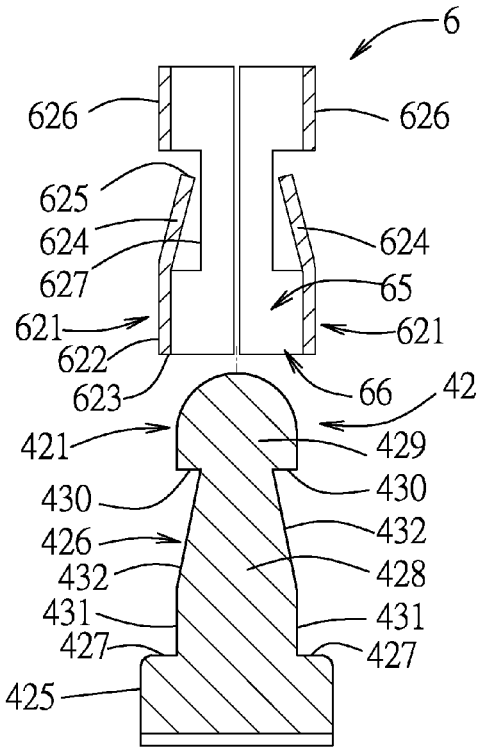
FIG. 8 is a schematic sectional view of the first embodiment of an electronic device including an assembly of an electrical connector and a cable unit according to this disclosure to illustrate an assembling relation ship between the adapter terminal and the insert arm of the conductive terminal.
Figure 10:
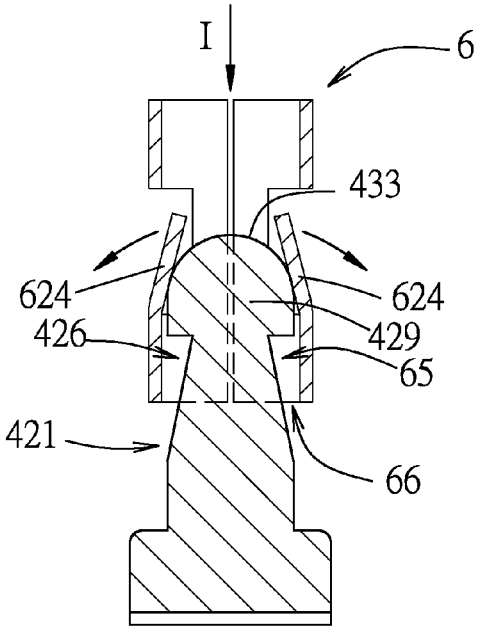
FIG. 10 is a schematic sectional view of the first embodiment of an electronic device including an assembly of an electrical connector and a cable unit according to this disclosure to illustrate that the adapter terminal is sleeved on the insert arm of the conductive terminal along the downward assembling direction and that a top pushing head portion of the insert arm is disposed to push two resilient arms to deform and bend outward.

Referring to FIGS. 6, 7, and 8, each of the conductive terminals 42 further includes a protruding arm 422 protruding horizontally from a side of the insulator body 41. The protruding arm 422 has a top surface 423 and a distal end 424 distal from the insulator body 41. The insert arm 421 extends upward from the distal end 424 of the protruding arm 422. Each of the adapter terminals 6 is manufactured by impact molding a metal material. Each of the adapter terminals 6 includes a base plate 61, two sleeve plates 62 respectively connected to two opposite sides of the base plate 61 and disposed to sleeve on the insert arm 421 of the corresponding one of the conductive terminals 42, and two first gripping plates 63 respectively connected to the opposite sides of the base plate 61 and disposed to grip the core wire 521 of the corresponding one of the cables 52. The insert arm 421 of each of the conductive terminals 42 extends upward from the distal end 424 of the protruding arm 422 so that the two sleeve plates 62 of each of the adapter terminals 6 are sleeved on the insert arm 421 of the corresponding one of the conductive terminals 42 along a downward assembling direction (I), as shown in FIG. 10. Therefore, when each of the adapter terminals 6 is sleeved on the corresponding insert arm 421, the space occupied by the adapter terminals 6 within the receiving space 20 of the shell body 12 may be reduced so as to avoid influencing the disposition of other electronic elements.

The base plate 61 of each of the adapter terminals has a rectangular shape, and extends along a longitudinal direction parallel to the downward assembling direction (I). For each of the adapter terminals 6, the base plate 61 has a first surface 611 and a second surface 612 opposite to the first surface 611. The two sleeve plates 62 extend from the base plate 61 in a direction opposite to the second surface 612, and the two first gripping plates 63 extend from the base plate 61 in a direction opposite to the first surface 611. The core wire 521 of the corresponding one of the cables 52 may be inserted between the two first gripping plates 63 along the downward assembling direction (I) so that the two first gripping plates 63 are disposed to grip the core wire 521 of the corresponding one of the cables 52. Since the core wire 521 of each of the cables 52 may not be obstructed by the two sleeve plates during the act of inserting, the assembling convenience and flexibility may be effectively enhanced.

Specifically, in this embodiment, each of the cables 52 further includes an insulator sheath 522 covering the core wire 521. The core wire 521 extends out of an end of the insulator sheath 522. Each of the adapter terminals 6 further includes two second gripping plates 64 respectively connected to the opposite sides of the base plate 61. The two second gripping plates 64 extend from the base plate 61 in the direction opposite to the first surface 611. The two second gripping plates 64 are positioned between the two first gripping plates 63 and the two sleeve plates 62, and are disposed to grip the insulator sheath 522 of the corresponding one of the cables 52. Each of the cables 52 is inserted along the downward assembling direction (I) to be disposed between the two first gripping plates 63 and between the two second gripping plates 64 so that the two first gripping plates 63 and the two second gripping plates correspondingly grip the core wire 521 and the insulator sheath 522. Therefore, the adapter terminals 6 may firmly grip the cables 52 correspondingly so as to prevent the core wire 521 from departing from the two first gripping plates 63 due to the influence of an external force acting on the cables 52.

Figure 4:
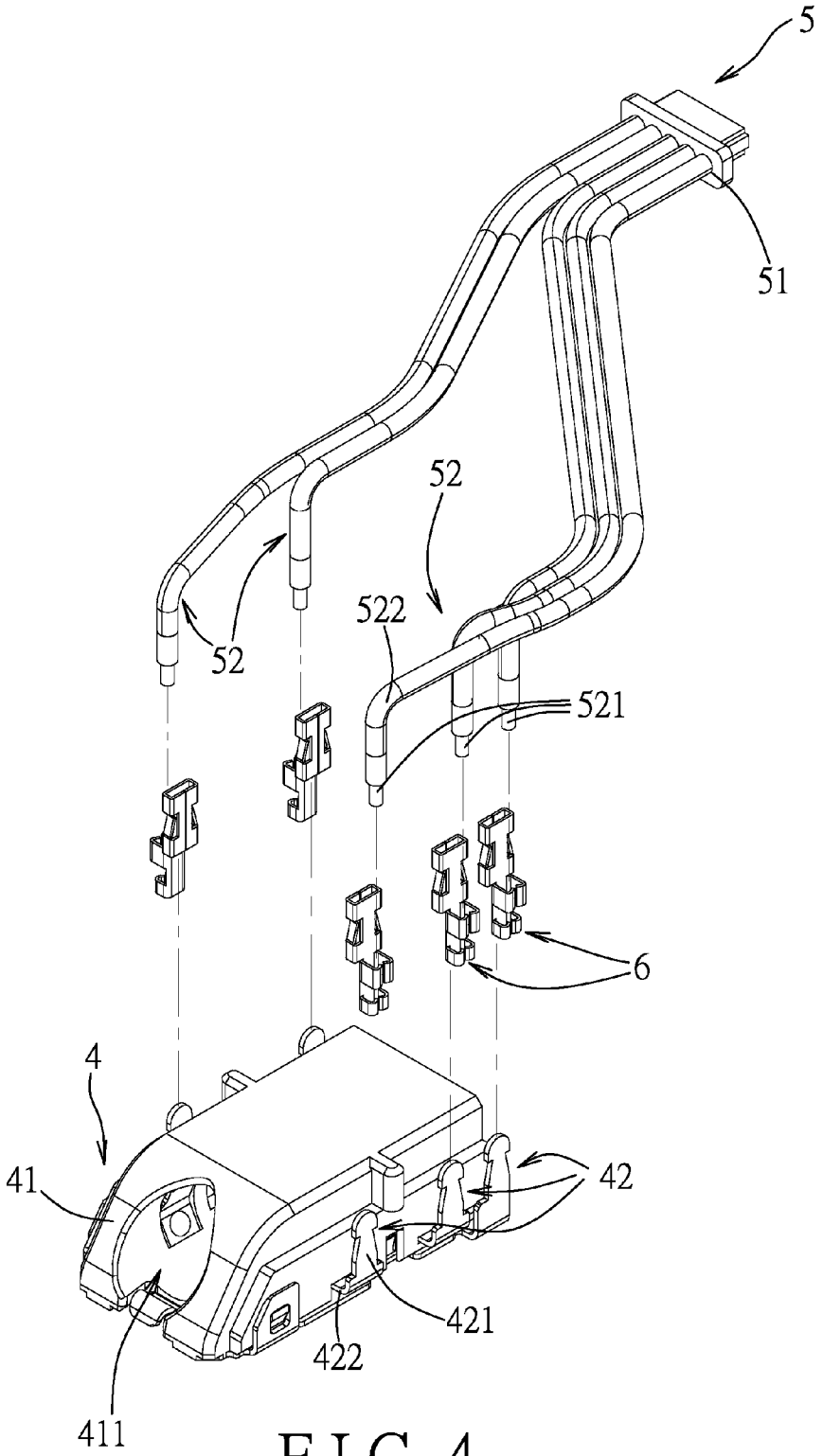
FIG. 4 is an exploded perspective view of the first embodiment of an electronic device including an assembly of an electrical connector and a cable unit according to this disclosure to illustrate an assembling relationship of the adapter terminals, the cables, and the conductive terminals.
Figure 5:
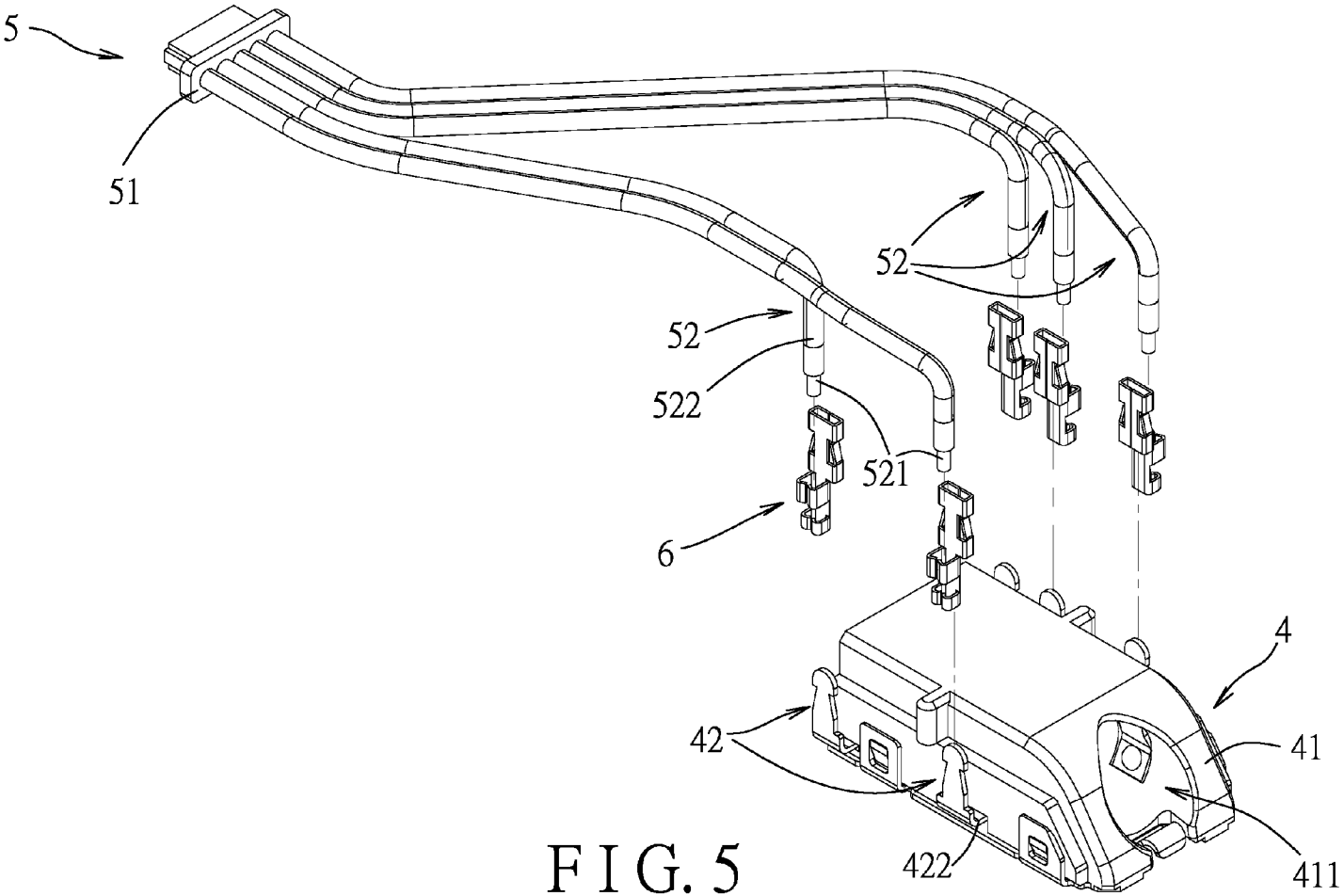
FIG. 5 is another exploded perspective view of the first embodiment of an electronic device including an assembly of an electrical connector and a cable unit according to this disclosure to illustrate the assembling relationship of the adapter terminals, the cables, and the conductive terminals.

For each of the adaptor terminals 6, the base plate 61 cooperates with the two sleeve plates 62 to define a receiving slot 65 for receiving the insert arm 421 of a corresponding one of the conductive terminals 42, and a bottom opening 66 in spatial communication with the receiving slot 65. The insert arm 421 of the corresponding one of the conductive terminals 42 is extended into the receiving slot 65 through the bottom opening 66. The insert arm 421 of each of the conductive terminals 42 includes an extending segment 425 extending upward from the distal end 424 of the protruding arm 422 and having a top end, and an insert segment 426 extending upward from the top end of the extending segment 425 and having two opposite sides. The insert segment 426 has a width shorter than that of the extending segment 425. The extending segment 425 has at least one support face 427 located on the top end and connected to the insert segment 426. In this embodiment, as shown in FIGS. 4 and 5, the extending segment 425 of each of two conductive terminals 42 proximate to a rear end of the insulator body 41 has one support face 427, and the extending segment 425 of each of the remaining conductive terminals 42 has two of the support faces 427 located on the top end and respectively connected to the opposite sides of the insert segment 426.

Referring to FIGS. 6, 7, and 8, each of the sleeve plates 62 of each of the adapter terminals 6 has a lower surrounding plate segment 621 connected to a side of the base plate 61 and disposed to surround the insert segment 426 of the insert arm 421 of the corresponding one of the conductive terminals 42. The lower surrounding plate segments 621 of the two sleeve plates 62 cooperate with the base plate 61 to define the bottom opening 66. The lower surrounding plate segment 621 includes aside plate portion 622. The side plate portions 622 of the lower surrounding plate segments 621 of the sleeve plates 62 of each of the adapter terminals 6 are located respectively at the opposite sides of the insert segment 426 of the insert arm 421 of the corresponding one of the conductive terminals 42. The side plate portion 622 of the lower surrounding plate segment 621 has an abutting face 623 at a bottom of the side plate portion 622 for abutting against a corresponding one of the support faces 427 of the extending segment 425 of the insert arm 421 of the corresponding one of the conductive terminals 42. The moving route of each of the adapter terminals 6 when being sleeved on the insert arm 421 of the corresponding one of the conductive terminals 42 along the downward assembling direction (I) may be limited accordingly.

Each of the sleeve plates 62 further includes a resilient arm 624 extending upward from a top end of one of the side plate portions 622 and inclining inward. The two resilient arms 624 converge toward each other along an upward direction. Each resilient arm 624 has a top locking end 625. The insert segment 426 of the insert arm 421 of each of the conductive terminals 42 has a neck portion 428 connected to the extending segment 425, and a top pushing head portion 429 formed on a top end of the neck portion 428. The top pushing head portion 429 of the insert segment 426 of the insert arm 421 of each of the conductive terminals 42 further has a curved top pushing face 433 for pushing the resilient arms 624 of the two sleeve plates 62 of the corresponding one of the adapter terminals 6. The top pushing head portion 429 is disposed to push the resilient arms 624 of the sleeve plates 62 of the corresponding one of the adapter terminals 6 to deform and bend outward so that the top pushing head portion 429 may pass over the top locking ends 625 of the resilient arms 624. The top pushing head portion 429 has two bottom stop faces 430 connected respectively to opposite sides of the neck portion 428 for stopping the top locking ends 625 of the resilient arms 624 of the corresponding one of the adapter terminals 6. The insert segment 426 of the insert arm 421 may thus be prevented from separating from the receiving slot 65 through the bottom opening 66. Therefore, the two sleeve plates 62 of each of the adapter terminals 6 may be positioned firmly on the corresponding insert arm 421 after they are disposed to sleeve on the insert arm 421 of the corresponding one of the conductive terminals 42. It should be noted that the number of the resilient arm 624 and the number of the stop face 430 may be respectively one and that the effect of preventing the insert segment 426 of the insert arm 421 from separating from the receiving slot 65 through the bottom opening 66 can be likewise achieved.

Specifically, the neck portion 428 of the insert segment 426 of the insert arm 421 of each of the conductive terminals 42 has two opposite upright side surfaces 431 and two inclined side surfaces 432 respectively connected to top ends of the two upright side surfaces 431. The two inclined side surfaces 432 extend upward and converge toward each other and are respectively connected to the bottom stop faces 430 of the top pushing head portion 429. When the two sleeve plates 62 of each of the adapter terminals 6 are disposed to sleeve on the insert arm 421 of the corresponding one of the conductive terminals 42, the lower surrounding plate segments 621 of each of the adapter terminals 6 surround the neck portion 428 of the insert segment 426 of the insert arm 421 of the corresponding one of the conductive terminals 42 so that the side plate portions 622 of the lower surrounding plate segments 621 are disposed outwardly and respectively of the upright side surfaces 431 of the neck portion 428 of the insert segment 426 of the insert arm 421 of the corresponding one of the conductive terminals 42. The resilient arms 624 of each of the adapter terminals 6 grip the inclined side surfaces 432 of the neck portion 428 of the insert segment 426 of the insert arm 421 of the corresponding one of the conductive terminals 42. Accordingly, each of the adapter terminals 6 may be prevented from shaking or rotating relative to the insert arm 421 of the corresponding one of the conductive terminals 42. Preferably, each of the sleeve plates 62 of each of the adapter terminals 6 further includes an upper surrounding plate segment 626 connected to the base plate 61 and spaced apart from and located above the resilient arms 624. The upper surrounding plate segments 626 of the sleeve plates 62 surround the top pushing head portion 429 of the insert segment 426 of the insert arm 421 of the corresponding one of the conductive terminals 42. The upper surrounding plate segments 626 are correspondingly connected to the lower surrounding plate segments 621 via two connecting plate segments 627 spaced apart from the base plate 61. Accordingly, the sleeve plates 62 may enclose and surround the insert segment 426 of the insert arm 421 of the corresponding one of the conductive terminals 42 so as to further ensure that each of the adapter terminals 6 may be prevented from shaking or rotating relative to the insert arm 421 of the corresponding one of the conductive terminals 42.

Figure 9:
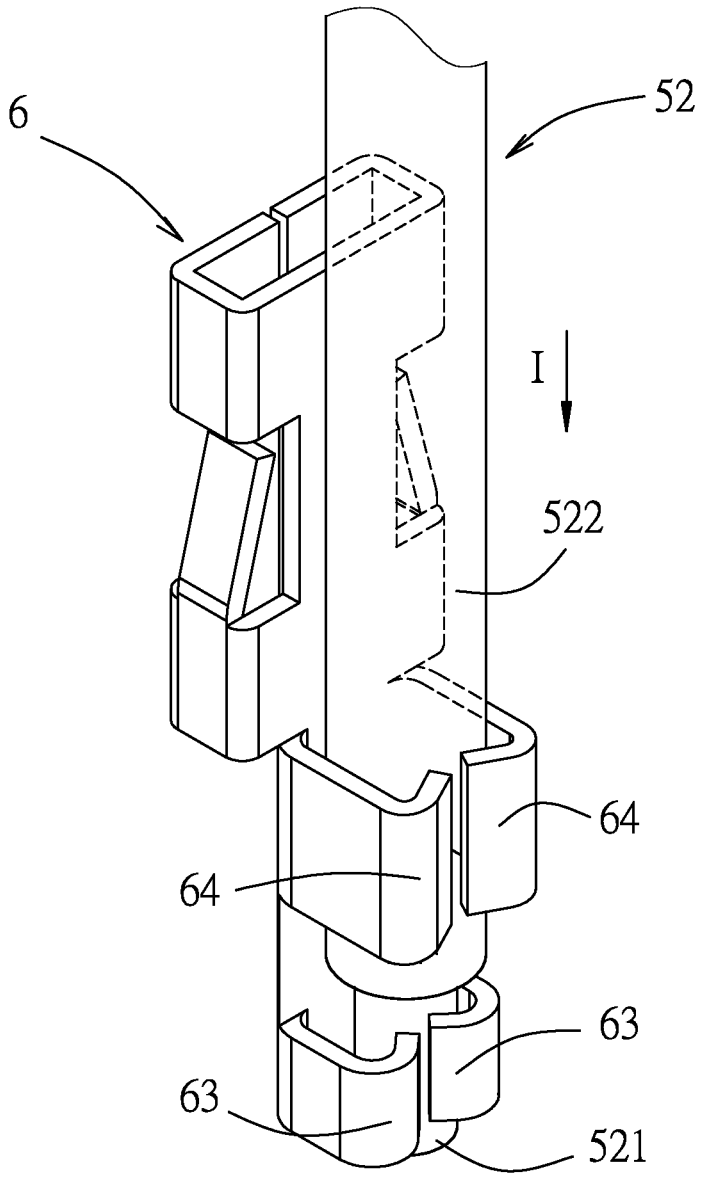
FIG. 9 is an assembling schematic view of the first embodiment of an electronic device including an assembly of an electrical connector and a cable unit according to this disclosure to illustrate that the cable is inserted to be disposed between two first gripping plates and between two second gripping plates of the adapter terminal along a downward assembling direction.

Referring to FIGS. 4 and 9, when assembling together the cable unit 5, the adapter terminals 6, and the electrical connector 4, first, each of the cables 52 is inserted along the downward assembling direction (I) to be disposed between the two first gripping plates 63 and between the two second gripping plates 64 of a corresponding one of the adapter terminals 6 so that the two first gripping plates 63 and the two second gripping plates 64 correspondingly grip the core wire 521 and the insulator sheath 522 of the cables 52.

Figure 11:
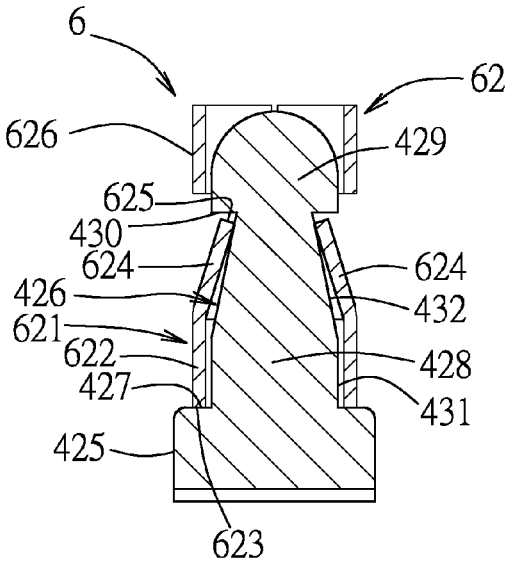
FIG. 11 is a schematic sectional view of the first embodiment of an electronic device including an assembly of an electrical connector and a cable unit according to this disclosure to illustrate that two sleeve plates of the adapter terminal are sleeved on an insert segment of the insert arm.

Referring to FIGS. 8, 10, and 11, the bottom opening 66 of each of the adapter terminals 6 is then aligned with the insert arm 421 of a corresponding one of the conductive terminals 42. Each of the adapter terminals is then sleeved on the insert arm 421 of the corresponding one of the conductive terminals 42 along the downward assembling direction (I). In the course of moving each of the adapter terminals 6 along the downward assembling direction (I), the insert segment 426 of the insert arm 421 of the corresponding one of the conductive terminals 42 is extended into the receiving slot 65 through the bottom opening 66. When the curved top pushing face 433 of the top pushing head portion 429 of the insert segment 426 of the insert arm 421 of each of the conductive terminals 42 abuts against the resilient arms 624 of the two sleeve plates 62 of the corresponding one of the adapter terminals 6, two horizontal forces imparted by the curved top pushing face 433 respectively to the resilient arms 624 may push the resilient arms 624 to deform and bend outward, and the resilient arms 624 store a restoring force. When the corresponding one of the adapter terminals 6 is moved downward to a position in which the resilient arms 624 separate from the top pushing head portion 429, the resilient arms 624 may be restored via the restoring force and grip the inclined side surfaces 432 of the neck portion 428 of the insert segment 426 of the insert arm 421 of the corresponding one of the conductive terminals 42. When the abutting face 623 of the side plate portion 622 abuts against a corresponding one of the support faces 427, the two sleeve plates 62 of each of the adapter terminals 6 are sleeved on the insert segment 426 of the insert arm 421 of the corresponding one of the conductive terminals 42. At this time, the two sleeve plates 62 enclose and surround the insert segment 426. Since the bottom stop faces 430 stop the top locking ends 625 of the resilient arms 624 of the corresponding one of the adapter terminals 6, the insert segment 426 of the insert arm 421 may be prevented from separating from the receiving slot 65 through the bottom opening 66. Therefore, the two sleeve plates 62 of each of the adapter terminals 6 may be positioned firmly on the insert segment 426 of the corresponding insert arm 421.

Figure 12:
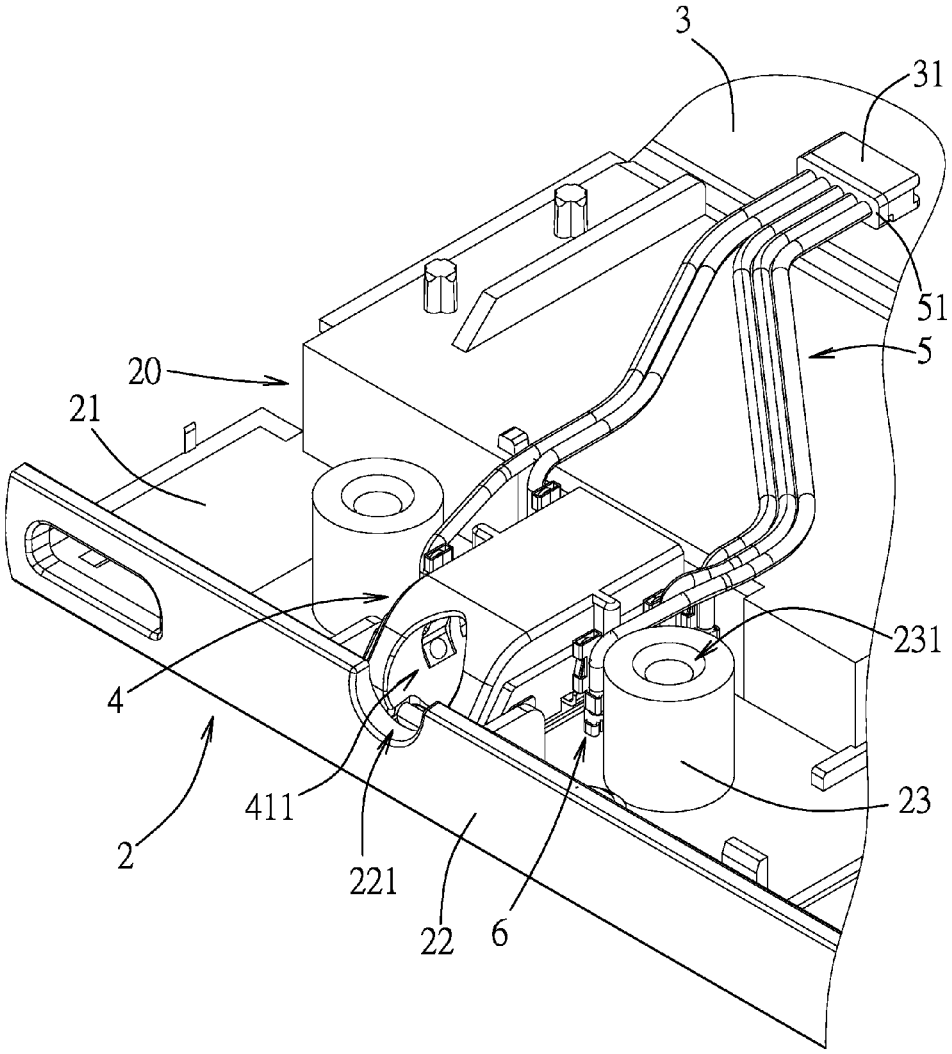
FIG. 12 is a fragmentary enlarged perspective view of the first embodiment of an electronic device including an assembly of an electrical connector and a cable unit according to this disclosure to illustrate that the electrical connector is disposed on a bottom wall of the shell body and that a plug connector of the cable unit is plugged in a socket connector of a mother board.

Referring to FIG. 12, the electrical connector 4 is then disposed on the bottom wall 21 of the shell body 2 so that the insert hole 411 of the electrical connector 4 corresponds to the opening 221 in the side wall 22 in position. The plug connector 51 of the cable unit 5 is then connected to the socket connector 31 of the mother board 3. At this time, the electrical connector 4 is electrically connected to the mother board 3 through the adapter terminals 6 and the cable unit 5.

Referring to FIGS. 2 and 12, in order to position the electrical connector 4 firmly within the receiving space 20, in this embodiment, a baffle plate 7 is disposed on two posts 23 provided on the bottom wall 21 of the shell body 2 so that the baffle plate 7 abuts against a top side of the insulator body 41 of the electrical connector 4. Two screws 8 then pass through two through holes (not shown) in the baffle plate 7 correspondingly and engage threaded holes 231 in the posts 23 correspondingly so as to lock the baffle plate 7 on the posts 23. The electrical connector 4 may be prevented from moving relative to the bottom wall 21 by the baffle plate 7 abutting against the top side of the insulator body 41 of the electrical connector 4. Therefore, the electrical connector 4 may be positioned firmly within the receiving space 20.

Figure 13:
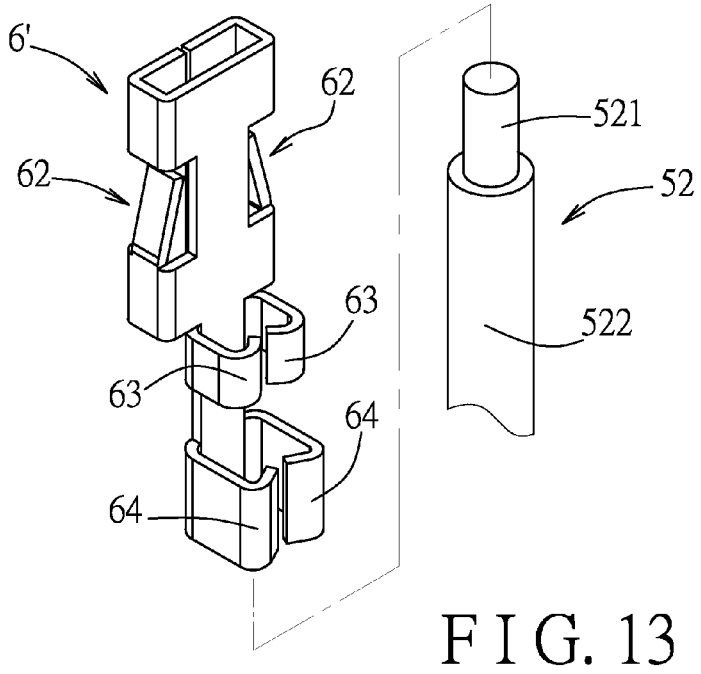
FIG. 13 is a fragmentary exploded perspective view of a second embodiment of an electronic device including an assembly of an electrical connector and a cable unit according to this disclosure to illustrate an assembling relationship between the adapter terminal and the cable.
Figure 14:
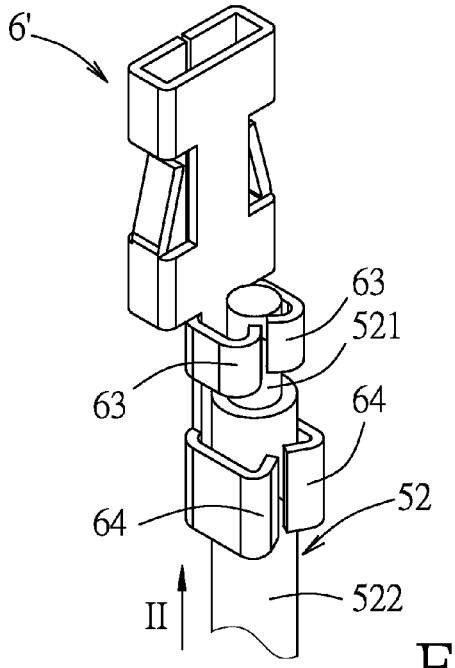
FIG. 14 is an assembling schematic view of the second embodiment of an electronic device including an assembly of an electrical connector and a cable unit according to this disclosure to illustrate the cable is inserted to be disposed between the two first gripping plates and between the two second gripping plates of the adapter terminal along an upward installing direction.

Referring to FIGS. 13 and 14, a second embodiment of an electronic device according to this disclosure is illustrated to include adapter terminals 6' which have a structure slightly different from that of the adapter terminals 6 used in the first embodiment.

In the second embodiment, in each of the adapter terminals 6', the two first gripping plates 63 are positioned between the two second gripping plates 64 and the two sleeve plates 62. Each of the cables 52 is inserted along an upward installing direction (II) opposite to the downward assembling direction (I) to be disposed between the two first gripping plates 63 and between the two second gripping plates 64 so that the two first gripping plates 63 and the two second gripping plates 64 correspondingly grip the core wire 521 and the insulator sheath 522 of the cable 52.

In view of the aforesaid, in the disclosed embodiments, each of the adapter terminals 6, 6' is connected to the core wire 521 of the corresponding one of the cables and is sleeved on the insert arm 421 of the corresponding one of the conductive terminals 42. Each of the conductive terminals 42 of the electrical connector 4 may be electrically connected to the core wire 521 of the corresponding one of the cables 52 through the corresponding one of the adapter terminals 6. Therefore, assembling convenience is enhanced and assembling time is reduced.

While the present disclosure has been described in connection with what are considered the most practical and preferred embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An assembly of an electrical connector and a cable unit, comprising:

the electrical connector including an insulator body and a plurality of conductive terminals disposed at said insulator body, each of said conductive terminals protruding partly outside said insulator body, and including an insert arm positioned outside said insulator body;

the cable unit including a plug connector and a plurality of cables connected to said plug connector, each of said cables including a core wire; and a plurality of adapter terminals each connected to said core wire of a corresponding one of said cables and sleeved on said insert arm of a corresponding one of said conductive terminals, each of said adapter terminals being electrically connected between said core wire of the corresponding one of said cables and said insert arm of the corresponding one of said conductive terminals.

2. The assembly of an electrical connector and a cable unit according to claim 1, wherein each of said conductive terminals further includes a protruding arm protruding from said insulator body, said protruding arm having a top surface and a distal end distal from said insulator body, said insert arm extending upward from said distal end of said protruding arm, each of said adapter terminals including a base plate, two sleeve plates respectively connected to two opposite sides of said base plate and disposed to sleeve on said insert arm of the corresponding one of said conductive terminals, and two first gripping plates respectively connected to said opposite sides of said base plate and disposed to grip said core wire of the corresponding one of said cables, said two sleeve plates of each of said adapter terminals being sleeved on said insert arm of the corresponding one of said conductive terminals along a downward assembling direction.

3. The assembly of an electrical connector and a cable unit according to claim 2, wherein, for each of said adapter terminals, said base plate has a first surface and a second surface opposite to said first surface, said two sleeve plates extend from said base plate in a direction opposite to said second surface, and said two first gripping plates extend from said base plate in a direction opposite to said first surface.

4. The assembly of an electrical connector and a cable unit according to claim 3, wherein each of said cables further includes an insulator sheath covering said core wire, each of said adapter terminals further including two second gripping plates respectively connected to said opposite sides of said base plate and disposed to grip said insulator sheath of the corresponding one of said cables, said two second gripping plates extending from said base plate in said direction opposite to said first surface, said two second gripping plates being positioned between said two first gripping plates and said two sleeve plates.

5. The assembly of an electrical connector and a cable unit according to claim 3, wherein each of said cables further includes an insulator sheath covering said core wire, each of said adapter terminals further including two second gripping plates respectively connected to said opposite sides of said base plate and disposed to grip said insulator sheath of the corresponding one of said cables, said two second gripping plates extending from said base plate in said direction opposite to said first surface, said two first gripping plates being positioned between said two second gripping plates and said two sleeve plates.

6. The assembly of an electrical connector and a cable unit according to claim 3, wherein, for each of said adapter terminals, said base plate cooperates with said two sleeve plates to define a receiving slot and a bottom opening in spatial communication with said receiving slot, said insert arm of the corresponding one of said conductive terminals being extended into said receiving slot through said bottom opening, said insert arm of each of said conductive terminals including at least one support face and at least one stop face spaced apart from and located above said support face, one of said sleeve plates including an abutting face abutting against said support face of said insert arm of the corresponding one of said conductive terminals, and a resilient arm located below said stop face of said insert arm of the corresponding one of said conductive terminals, said stop face stopping said resilient arm to prevent said insert arm from separating from said receiving slot through said bottom opening.

7. The assembly of an electrical connector and a cable unit according to claim 6, wherein said insert arm of each of said conductive terminals includes an extending segment extending upward from said distal end of said protruding arm and having a top end, and an insert segment extending upward from said top end of said extending segment and having two opposite sides, said insert segment having a width shorter than that of said extending segment, said extending segment having two of said support faces located on said top end and respectively connected to said opposite sides of said insert segment, each of said sleeve plates of each of said adapter terminals having a lower surrounding plate segment connected to said base plate and disposed to surround said insert segment of said insert arm of the corresponding one of said conductive terminals, said lower surrounding plate segment including a side plate portion, said side plate portions of said lower surrounding plate segments of said sleeve plates of each of said adapter terminals being located respectively at said opposite sides of said insert segment of said insert arm of the corresponding one of said conductive terminals, said side plate portion having said abutting face at a bottom of said side plate portion for abutting against a corresponding one of said support faces of said extending segment of said insert arm of the corresponding one of said conductive terminals.

8. The assembly of an electrical connector and a cable unit according to claim 7, wherein each of said sleeve plates of each of said adapter terminals has said resilient arm extending upward from a top end of said side plate portion and inclining inward, said resilient arm having a top locking end, said insert segment of said insert arm of each of said conductive terminals having a neck portion connected to said extending segment, and a top pushing head portion formed on a top end of said neck portion, said top pushing head portion being disposed to push said resilient arms of said sleeve plates of the corresponding one of said adapter terminals to deform and bend outward, said top pushing head portion having two bottom stop faces connected respectively to opposite sides of said neck portion for stopping said top locking ends of said resilient arms of the corresponding one of said adapter terminals.

9. The assembly of an electrical connector and a cable unit according to claim 8, wherein said top pushing head portion of said insert segment of said insert arm of each of said conductive terminals further has a curved top pushing face for pushing said resilient arms of said two sleeve plates of the corresponding one of said adapter terminals.

10. The assembly of an electrical connector and a cable unit according to claim 8, wherein said neck portion of said insert segment of said insert arm of each of said conductive terminals has two opposite upright side surfaces and two inclined side surfaces respectively connected to top ends of said two upright side surfaces, said two inclined side surfaces extending upward and converging toward each other and being respectively connected to said bottom stop faces of said top pushing head portion, said lower surrounding plate segments of each of said adapter terminals surrounding said neck portion of said insert segment of said insert arm of the corresponding one of said conductive terminals, said side plate portions of said lower surrounding plate segments being disposed outwardly and respectively of said upright side surfaces of said neck portion of said insert segment of said insert arm of the corresponding one of said conductive terminals, said resilient arms of each of said adapter terminals gripping said inclined side surfaces of said neck portion of said insert segment of said insert arm of the corresponding one of said conductive terminals, each of said sleeve plates of each of said adapter terminals further including an upper surrounding plate segment connected to said base plate and spaced apart from and located above said resilient arms, said upper surrounding plate segments of said sleeve plates surrounding said top pushing head portion of said insert segment of said insert arm of the corresponding one of said conductive terminals.

11. An electronic device comprising:

a shell body formed with a receiving space, said shell body including a side wall formed with an opening that is in spatial communication with said receiving space;

a mother board disposed within said receiving space and including a socket connector;

an electrical connector disposed in said receiving space and disposed proximate to said side wall, said electrical connector including an insulator body and a plurality of conductive terminals disposed at said insulator body, said insulator body being formed with an insert hole corresponding to said opening, each of said conductive terminals protruding partly outside said insulator body, and including an insert arm positioned outside said insulator body;

a cable unit disposed in said receiving space, said cable unit including a plug connector connected to said socket connector, and a plurality of cables connected to said plug connector, each of said cables including a core wire; and a plurality of adapter terminals each connected to said core wire of a corresponding one of said cables and sleeved on said insert arm of a corresponding one of said conductive terminals, each of said adapter terminals being electrically connected between said core wire of the corresponding one of said cables and said insert arm of the corresponding one of said conductive terminals.

12. The electronic device according to claim 11, wherein each of said conductive terminals further includes a protruding arm protruding from said insulator body, said protruding arm having a top surface and a distal end distal from said insulator body, said insert arm extending upward from said distal end of said protruding arm, each of said adapter terminals including a base plate, two sleeve plates respectively connected to two opposite sides of said base plate and disposed to sleeve on said insert arm of the corresponding one of said conductive terminals, and two first gripping plates respectively connected to said opposite sides of said base plate and disposed to grip said core wire of the corresponding one of said cables, said two sleeve plates of each of said adapter terminals being sleeved on said insert arm of the corresponding one of said conductive terminals along a downward assembling direction.

13. The electronic device according to claim 12, wherein, for each of said adapter terminals, said base plate has a first surface and a second surface opposite to said first surface, said two sleeve plates extend from said base plate in a direction opposite to said second surface, and said two first gripping plates extend from said base plate in a direction opposite to said first surface.

14. The electronic device according to claim 13, wherein each of said cables further includes an insulator sheath covering said core wire, each of said adapter terminals further including two second gripping plates respectively connected to said opposite sides of said base plate and disposed to grip said insulator sheath of the corresponding one of said cables, said two second gripping plates extending from said base plate in said direction opposite to said first surface, said two second gripping plates being positioned between said two first gripping plates and said two sleeve plates.

15. The electronic device according to claim 13, wherein each of said cables further includes an insulator sheath covering said core wire, each of said adapter terminals further including two second gripping plates respectively connected to said opposite sides of said base plate and disposed to grip said insulator sheath of the corresponding one of said cables, said two second gripping plates extending from said base plate in said direction opposite to said first surface, said two first gripping plates being positioned between said two second gripping plates and said two sleeve plates.

16. The electronic device according to claim 13, wherein, for each of said adapter terminals, said base plate cooperates with said two sleeve plates to define a receiving slot and a bottom opening in spatial communication with said receiving slot, said insert arm of the corresponding one of said conductive terminals being extended into said receiving slot through said bottom opening, said insert arm of each of said conductive terminals including at least one support face and at least one stop face spaced apart from and located above said support face, one of said sleeve plates including an abutting face abutting against said support face of said insert arm of the corresponding one of said conductive terminals, and a resilient arm located below said stop face of said insert arm of the corresponding one of said conductive terminals, said stop face stopping said resilient arm to prevent said insert arm from separating from said receiving slot through said bottom opening.

17. The electronic device according to claim 16, wherein said insert arm of each of said conductive terminals includes an extending segment extending upward from said distal end of said protruding arm and having a top end, and an insert segment extending upward from said top end of said extending segment and having two opposite sides, said insert segment having a width shorter than that of said extending segment, said extending segment having two of said support faces located on said top end and respectively connected to said opposite sides of said insert segment, each of said sleeve plates of each of said adapter terminals having a lower surrounding plate segment connected to said base plate and disposed to surround said insert segment of said insert arm of the corresponding one of said conductive terminals, said lower surrounding plate segment including a side plate portion, said side plate portions of said lower surrounding plate segments of said sleeve plates of each of said adapter terminals being located respectively at said opposite sides of said insert segment of said insert arm of the corresponding one of said conductive terminals, said side plate portion having said abutting face at a bottom of said side plate portion for abutting against a corresponding one of said support faces of said extending segment of said insert arm of the corresponding one of said conductive terminals.

18. The electronic device according to claim 17, wherein each of said sleeve plates of each of said adapter terminals has said resilient arm extending upward from a top end of said side plate portion and inclining inward, said resilient arm having a top locking end, said insert segment of said insert arm of each of said conductive terminals having a neck portion connected to said extending segment, and a top pushing head portion formed on a top end of said neck portion, said top pushing head portion being disposed to push said resilient arms of said sleeve plates of the corresponding one of said adapter terminals to deform and bend outward, said top pushing head portion having two bottom stop faces connected respectively to opposite sides of said neck portion for stopping said top locking ends of said resilient arms of the corresponding one of said adapter terminals.

19. The electronic device according to claim 18, wherein said top pushing head portion of said insert segment of said insert arm of each of said conductive terminals further has a curved top pushing face for pushing said resilient arms of said two sleeve plates of the corresponding one of said adapter terminals.

20. The electronic device according to claim 18, wherein said neck portion of said insert segment of said insert arm of each of said conductive terminals has two opposite upright side surfaces and two inclined side surfaces respectively connected to top ends of said two upright side surfaces, said two inclined side surfaces extending upward and converging toward each other and being respectively connected to said bottom stop faces of said top pushing head portion, said lower surrounding plate segments of each of said adapter terminals surrounding said neck portion of said insert segment of said insert arm of the corresponding one of said conductive terminals, said side plate portions of said lower surrounding plate segments being disposed outwardly and respectively of said upright side surfaces of said neck portion of said insert segment of said insert arm of the corresponding one of said conductive terminals, said resilient arms of each of said adapter terminals gripping said inclined side surfaces of said neck portion of said insert segment of said insert arm of the corresponding one of said conductive terminals, each of said sleeve plates of each of said adapter terminals further including an upper surrounding plate segment connected to said base plate and spaced apart from and located above said resilient arms, said upper surrounding plate segments of said sleeve plates surrounding said top pushing head portion of said insert segment of said insert arm of the corresponding one of said conductive terminals.

* * * * *